US011247508B2

(12) United States Patent
Rimpl

(10) Patent No.: US 11,247,508 B2
(45) Date of Patent: Feb. 15, 2022

(54) INSTALLATION FOR PROCESSING ROUND BLANK PARTS

(71) Applicant: SCHULER PRESSEN GMBH, Goeppingen (DE)

(72) Inventor: Stephan Rimpl, Schlier (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 381 days.

(21) Appl. No.: 16/220,122

(22) Filed: Dec. 14, 2018

(65) Prior Publication Data

US 2019/0118574 A1 Apr. 25, 2019

Related U.S. Application Data

(63) Continuation-in-part of application No. PCT/EP2017/063774, filed on Jun. 7, 2017.

(30) Foreign Application Priority Data

Jun. 22, 2016 (DE) ..... 10 2016 111 434.0

(51) Int. Cl.
*B44B 5/00* (2006.01)
*B44B 5/02* (2006.01)
(Continued)

(52) U.S. Cl.
CPC ..... *B44B 5/0076* (2013.01); *A44C 21/00* (2013.01); *B21D 43/14* (2013.01); *B44B 5/0052* (2013.01); *B44B 5/024* (2013.01)

(58) Field of Classification Search
CPC ..... B21D 43/14; B44B 5/024; B44B 5/0052; B44B 5/0076; Y10T 29/5127
(Continued)

(56) References Cited

U.S. PATENT DOCUMENTS 3,061,913 A * 11/1962 Schenk, Jr. ..... B21D 43/14 29/823
4,287,748 A 9/1981 Wolfthal
(Continued)

FOREIGN PATENT DOCUMENTS

CN 1236584 A 12/1999
CN 101147631 A 3/2008
(Continued)

OTHER PUBLICATIONS

English translation of Chinese Patent Office Action dated Jun. 10, 2020, for the corresponding Chinese Patent Application No. 20170038836.2 (4 pages).
(Continued)

*Primary Examiner* — Edward T Tolan
*Assistant Examiner* — Jared O Brown
(74) *Attorney, Agent, or Firm* — Ronald S. Lombard

(57) ABSTRACT

A flexible installation for producing at least two types of coins. In particular, the different coin types have a different number of round blank parts and/or have round blank parts made of different materials. The type and number of work steps necessary to produce the coins of the coin type in question differ between the different coin types. The installation has a number of stations, in which a round blank part is supplied and/or output and/or processed and/or measured and/or tested. At least one transporting device acts to transport the at least one round blank part between the stations. Preferably, two transporting devices are present, which can be controlled independently of each other and cooperate via a transfer station for the at least one round blank part. A control device controls the at least one transporting device and the stations depending on the coin type to be produced.

11 Claims, 4 Drawing Sheets

(51) Int. Cl.
*B21D 43/14* (2006.01)
*A44C 21/00* (2006.01)

(58) Field of Classification Search
USPC ..... 29/38 R
See application file for complete search history.

(56) References Cited

U.S. PATENT DOCUMENTS

| | | | | |
|---|---|---|---|---|
| 8,096,041 | B2 * | 1/2012 | Agrati | G06Q 10/08 29/563 |
| 9,707,657 | B2 * | 7/2017 | Lutz | B23Q 7/04 |
| 2009/0064751 | A1 | 3/2009 | Gregory | |

FOREIGN PATENT DOCUMENTS

| | | | | |
|---|---|---|---|---|
| DE | 41 13 971 | A1 | 11/1992 | |
| DE | 44 40 511 | A1 | 5/1996 | |
| DE | 44 40 511 | A1 | 5/1998 | |
| DE | 100 57 000 | A1 | 5/2001 | |
| DE | 10057000 | A1 * | 5/2001 | B44B 5/024 |
| EP | 0 280 615 | B1 | 10/1991 | |
| EP | 0 511 551 | A1 | 11/1992 | |
| EP | 0 320 731 | B1 | 6/1993 | |
| GB | 2 493 059 | A | 1/2013 | |
| GB | 2493059 | A | 1/2013 | |
| JP | 02071958 | A * | 3/1990 | |
| JP | H 2-71958 | A | 3/1990 | |
| JP | 10014626 | A * | 1/1998 | |
| JP | H 10-14626 | A | 1/1998 | |
| JP | 2001-205372 | A | 7/2001 | |
| JP | 2001205372 | A | 7/2001 | |

OTHER PUBLICATIONS

The Chinese Patent Office Action and Search Report dated Jun. 10, 2020, for the corresponding Chinese Patent Application No. 20170038836.2 in the Chinese language (6 pages).

The English Translation of the International Search Report for the corresponding international application PCT/EP2017/063774 (3 pages); dated Aug. 30, 2017.

An English translation of Japanese Patent Office Action—Notice of Rejection dated Mar. 31, 2021, for the corresponding Japanese Patent Application No. 2018-566228 (6 pages).

The Japanese Patent Office Action—Notice of Rejection dated Mar. 31, 2021, for the corresponding Japanese Patent Application No. 2018-566228 in the Japanese language (3 pages).

* cited by examiner

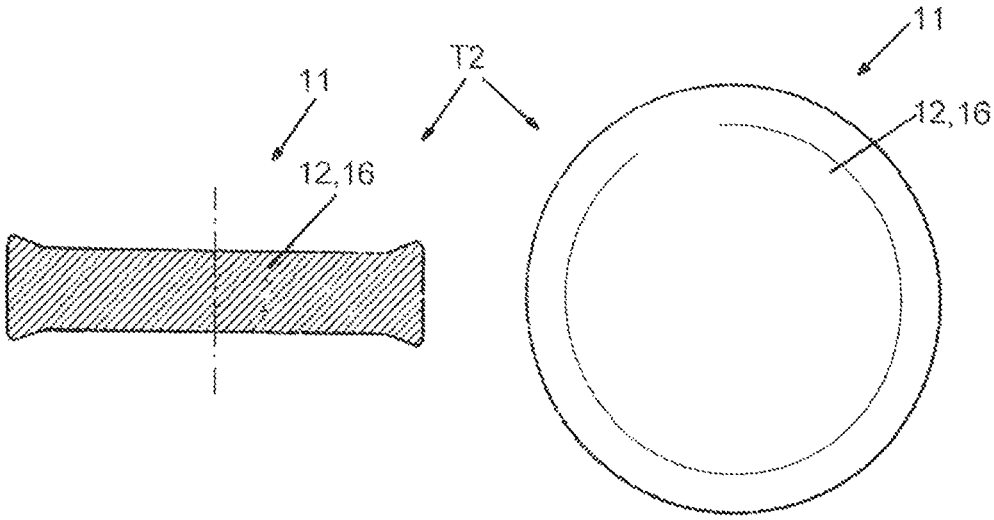
Fig.6
Fig.7
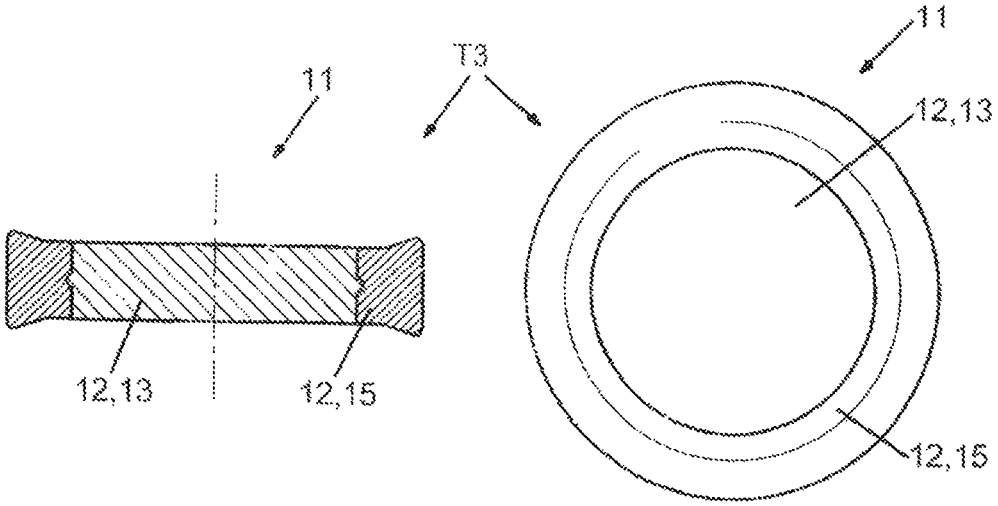
Fig.8
Fig.9

INSTALLATION FOR PROCESSING ROUND BLANK PARTS

CROSS-REFERENCE TO RELATED APPLICATIONS

This is a continuation-in-part application of pending international application PCT/EP2017/063774 filed Jun. 7, 2017, and claiming the priority of German application No. 10 2016 111 434.0 filed Jun. 22, 2016. The said International application PCT/EP2017/063774 and said German application No. 10 2016 111 434.0 are incorporated herein by reference in their entireties as though fully set forth.

BACKGROUND OF THE INVENTION

The invention relates to an installation for processing round blank parts in the production of coins.

Coins are known in various designs. There are coins that are stamped from a one-part, disc-shaped round blank. Other coins are assembled from two or three round blank parts. For example, the 1 euro coins or the 2 euro coins consist in each case of two round blank parts, specifically a round blank outer ring and a round blank core. Two or also more round blank parts from which a coin is to be produced are inserted one inside the other prior to the stamping of the coin. For example, they can have different colors or can consist of different materials.

Known coin stamping installations are designed for the production of specific coin designs or coin types. If one-piece coins are stamped, the accordingly pre-shaped round blanks can be supplied for example merely to one stamping press, stamped there, and then discharged again. In the case of multi-part round blanks, the round blank parts must be firstly inserted one inside the other and then stamped. The installations necessary for different coin types differ in complexity and size. On this basis, the object of the present invention can be considered that of simplifying the production of different coin types.

SUMMARY OF THE INVENTION

This object is achieved by an installation having the features of the claims.

The installation according to the invention is designed for processing and/or measuring and/or testing round blank parts when producing coins of different types. Here, a coin can be stamped from at least one round blank part. The installation is designed to be able to produce one, two or more coin types and/or to process and/or measure and/or test two or more coin types. Two coins belong to different coin types if:

- the type and/or number of work steps for producing the coins are/is different and/or
- the number of round blank parts are of different sizes and/or
- one coin comprises merely round blank parts made of metal materials and/or alloys, whereas the other coin comprises at least one round blank part containing plastic.

For example, in the case of multi-part round blanks the individual round blank parts are fitted one inside the other (additional work step), this step being spared in the case of another coin type formed from merely a one-part disc-shaped round blank. These are thus different coin types in the sense of the present application. Two three-part coins are also different coin types if one coin has merely metal round blank parts, whereas the other coin for example contains a round inner ring made of plastic.

The installation has a plurality of stations, which are each designed to process and/or to measure and/or to test the at least one round blank part of a round blank for production of a coin type. At least one station can also be used to supply a round blank part that is to be further transported to one or more other stations of a first transporting device or to discharge said round blank part from the first transporting device.

The first transporting device has at least one receptacle for the at least one round blank part of the round blank that is to be transported, by means of which the round blank part in question can be transported in the receptacle between the provided stations. A plurality of separate transporting devices can also be provided. The at least one transporting device can be formed by a gripper or manipulator, by a transporting device drivable rotatably about an axis of rotation, by a transporting device that transports linearly, or a combination thereof.

The installation has a control device. This is designed to control the provided stations depending on the coin type to be produced and to activate the stations necessary for the production of the coin type while the other stations are deactivated. If a coin type of the maximum possible complexity is thus produced, all provided stations can be activated and used in the production of the coin. If another coin type is to be produced, one or more of the available stations can remain unused and is/are deactivated accordingly. The stations themselves remain arranged on the first transporting device in this case. A complete dismantling or reconstruction of a station when production is adjusted to another coin type is not necessary.

The control device is also designed to control the first transporting device depending on the type of coin to be produced and in so doing to specify the transporting order in which the at least one round blank part used to produce the coin type is transported between the active stations. If a number of round blank parts are required for a round blank, each round blank part can pass through different stations or can pass through stations in a different order. It is possible here that a round blank part is also supplied to a passive station, but is neither processed nor measured or tested there, but instead merely remains in a passive station until it is transported further.

The installation can be very easily used in a versatile manner for the production of different coin types. The coin type to be produced will be predefined to the control device, which then controls the first transporting device and the stations depending on the coin type. A processing and/or measuring and/or testing of at least one round blank part takes place in the active stations, whereas in the passive stations there is no processing, measuring or testing of a round blank part.

The passive stations are brought into a passive state or idle state, in which they enable the round blank parts to be transported unhindered by means of the transporting device.

In one exemplary embodiment, the number of active stations for two producible coin types is different.

One or more of the following stations can be used as stations:

- a supplying station for a round blank part;
- a station for placing or fitting at least two round blank parts one inside the other;
- a station for reshaping an inner edge of a round blank ring or an outer edge of a round blank core;
- a station for compressing an edge of a round blank part;

- a station for annealing at least one round blank part;
- a station for cleaning the surface of at least one round blank part;
- a station for punching or drilling a starting part for producing a round blank ring and/or round blank core;
- a station for measuring or testing at least one dimension of at least one round blank part;
- a station for printing at least one round blank part;
- a station for calibrating the position or orientation of a round blank part relative to another round blank part or on the basis of another reference system;
- a station for outputting or discharging at least one round blank part;
- a transfer station for transferring at least one round blank part to a second transporting device different from the first transporting device;
- a station for injection-moulding at least one round blank part;
- a stamping station for stamping the coin from a one-part or multi-part round blank.

At least one stamping station for stamping a coin is preferably provided. It can be provided here that a separate stamping station is provided for each of two different coin types. The different coin types can then be stamped in each case by an allocated stamping station. Alternatively or additionally, it is also possible that one stamping station has an exchangeable—for example automatically exchangeable—stamping tool. Here, it is possible that the control device is designed to prompt the automatic exchange of the stamping tool depending on the coin type to be produced.

It is advantageous if a second transporting device is provided. The second transporting device has at least one receptacle for the at least one round blank part to be transported. The second transporting device is provided and designed in particular to transport the at least one round blank part to the stamping station. The second transporting device can alternatively or additionally also be designed to transport the coins stamped in the stamping station away from the stamping station.

The first transporting device and/or the second transporting device can each be designed to transport each of the round blank parts to be transported over a predefined circular path. To this end, the first and/or second transporting device can be formed for example by a respective turntable. The turntables can be arranged in planes oriented parallel to one another or in a common plane, for example in a horizontal plane. Each turntable is preferably drivable, in particular in steps, about an axis of rotation, preferably by means of a rotary drive.

The first and/or second transporting device can receive a plurality of receptacles each intended for one or more round blank parts. In the case of the embodiment by a relevant turntable, receptacles or pockets each for one or more round blank parts can be provided in a manner distributed equally along a circular path.

It can be advantageous if the first and/or second transporting device can be adapted to the coin type to be produced. For example, one or more receiving parts of the relevant transporting device which comprise the at least one receptacle in each case can be adapted or exchanged and therefore are adapted or exchanged depending on the coin type to be produced.

It is preferred if one station is embodied as a transfer station which is designed to transfer the at least one round blank part from the first transporting device to the second transporting device.

The temporal characteristic of the transport movement of the first transporting device can be different from the second characteristic of the transport movement of the second transporting device. In the case of clocked transport, the respective clock pulses can be different. Depending on the design of the transfer station for transferring the round blank parts arranged in a receptacle of the first transporting device into a receptacle of the second transporting device, the transport movements of the two transporting devices can also be performed completely independently of one another.

In one embodiment the control device is designed to control the first transporting device in such a way that the at least one round blank part is transported between stations in a first clock pulse. Alternatively or additionally, the control device can be designed to control the second transporting device in such a way that the at least one round blank part that is transported by means of the second transporting device is transported in a second clock pulse, in particular to the stamping station.

In one exemplary embodiment the at least one receptacle of the first transporting device and/or the second transporting device is moved in a clocked manner incrementally or intermittently between predefined positions, for example rotary positions. Each provided receptacle is thus moved on in the predefined clock pulse. A standstill period is provided between two incremental movements. The standstill periods for the first transporting device and the second transporting device can be different. The standstill period is required to process, measure, test, etc. at least one round blank part provided in a station.

Alternatively to the intermittent movement, a standstill-free movement of the relevant transporting device can also be performed. For example, a continuous movement with constant speed or with a speed that changes depending on position can be performed. The speed can be slower for example in the region of the stations or the predefined positions, and the transport of the at least one round blank part between the stations or the predefined positions can occur at a quicker speed.

It is possible here that at least one of the stations associated with a transporting device, as master, specifies the timing control for the transporting device and that the control of the other stations is adapted thereto.

It is additionally advantageous if the second transporting device is associated with at least one stamping station and the second clock pulse or the time characteristic of the transporting movement is adapted to a stroke movement of a press ram of a stamping press of the at least one stamping station. Such stamping presses are quick-running and must be operated with a minimum number of strokes. It is important that, during the operation of the stamping press, a round blank to be stamped is always present in the stamping tool of the stamping press. A working stroke of the stamping press without workpiece is avoided. To this end either a new round blank to be stamped is supplied with each stroke, or, if this is not possible, the round blank can be left in the stamping press over two or more strokes, until a new round blank can be supplied.

Each of the provided stations is preferably arranged at a fixedly predefined station place of the first transporting device and/or the second transporting device. The allocation of one station to a station place is unchangeable and is maintained independently of the coin type to be produced.

The stations are preferably arranged adjacently to one another along a circular path.

In a preferred embodiment at least four or five stations are provided.

BRIEF DESCRIPTION OF THE DRAWINGS

Preferred exemplary embodiments of the invention will be explained in detail hereinafter with reference to the accompanying drawings, in which:

FIG. 6 shows a cross-section and FIG. 7 a plan view of a second coin type consisting of a single disc-shaped round blank part; and FIG. 8 shows a cross-section and FIG. 9 a plan view of a third coin type consisting of two round blank parts.

DETAILED DESCRIPTION OF THE INVENTION

Figure 1:
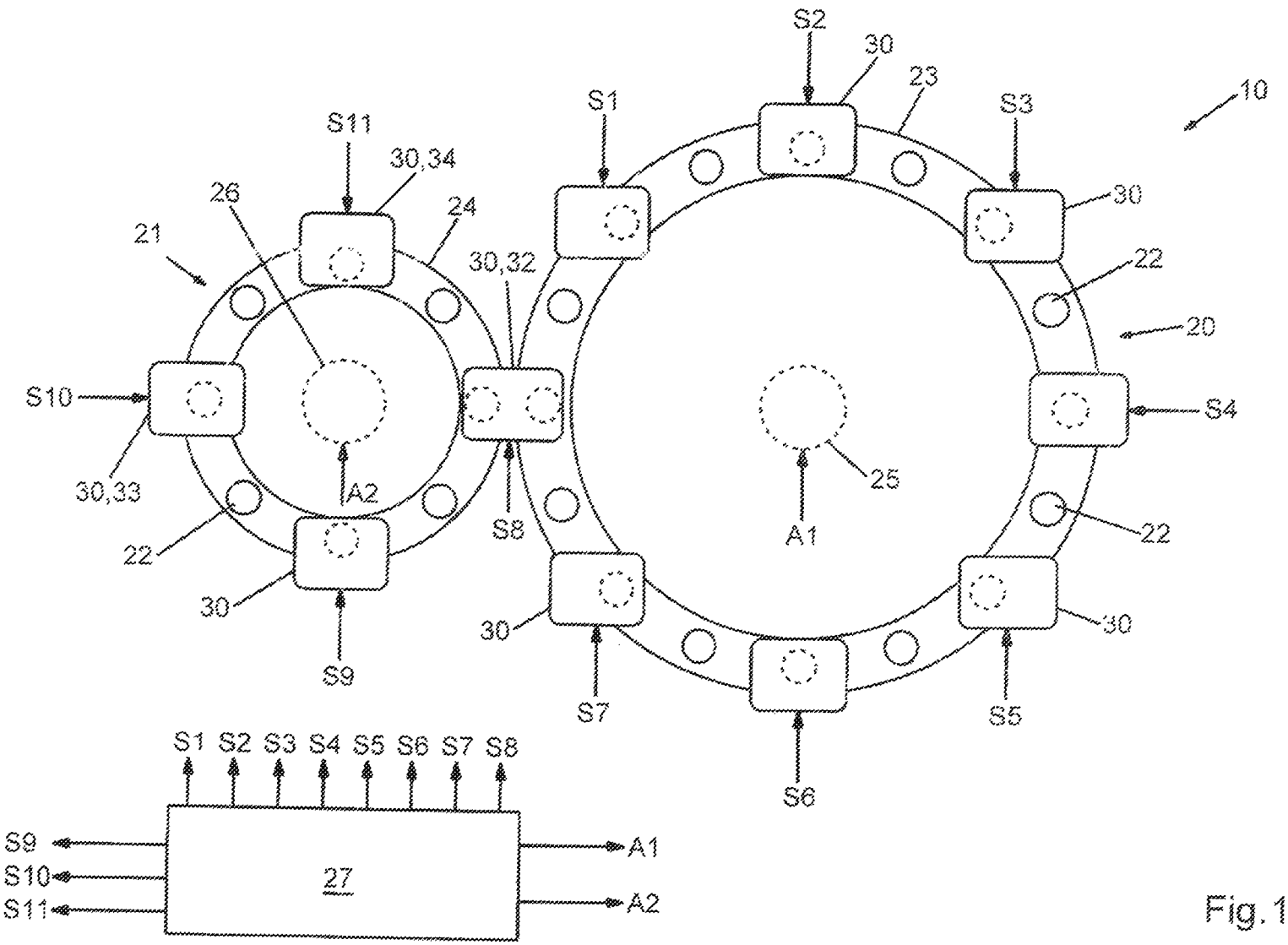
FIG. 1 shows a schematic diagram of an installation having two transporting devices, each of which is associated with a number of stations.

FIG. 1 shows, in a heavily schematised manner, a schematic diagram of an exemplary embodiment of an installation 10 for producing coins 11. Coin types differ in particular in that they require a different number of work steps or processing steps and/or a different type of processing.

Figure 4:
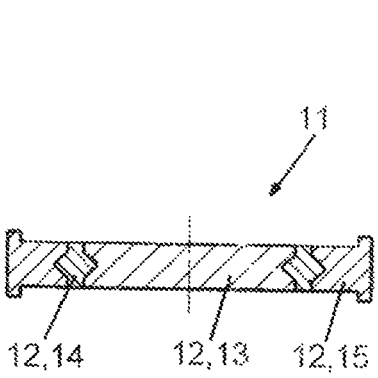
FIG. 4 shows a cross-section and FIG. 5 a plan view of a first coin type consisting of three round blank parts.
Figure 5:
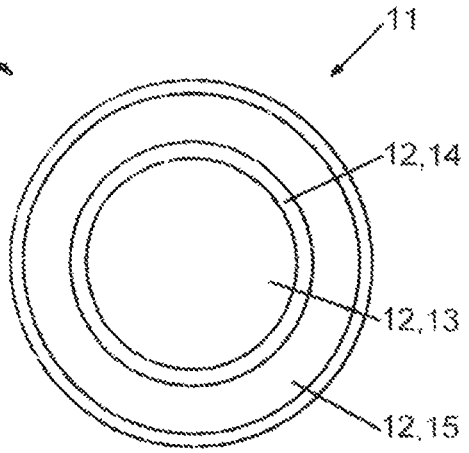

FIGS. 4 and 5 show a first coin type T1. The coin shown there is produced from a round blank which consists of three round blank parts 12. In the first coin type T1 the three round blank parts 12 are formed by a round blank core 13, by a round blank inner ring 14, and a round blank outer ring 15. The round blank rings 14, 15 are arranged coaxially to the round blank core 13, wherein the round blank inner ring 14 is arranged between the round blank core 13 and the round blank outer ring 15.

A second coin type T2 is shown in FIGS. 6 and 7. The coin 11 shown there of the second coin type T2 is produced from a single round blank part 12, which is formed by a circular disc 16.

A third coin type T3 is shown in FIGS. 8 and 9. The coin 11 of the third coin type T3 is produced from two round blank parts 12, specifically from a round blank core 13 and a round blank outer ring 15. In contrast to the first coin type T1, there is no round blank inner ring provided and the round blank core 13 and the round blank outer ring 15 are directly connected to one another.

The connection of a number of round blank parts 12, as is shown in FIGS. 4, 5, 8 and 9, can be implemented in a frictionally engaged and/or form-fitting manner. The form fit can be achieved when stamping the coin by way of an appropriate material flow.

Whereas the coin of type T2 consists of a uniform material, in particular of a metal alloy, further coin types can be formed on the basis of the shown multi-part coin types T1 and T3 depending on the used material, these further coin types for example consisting of round blank parts 12 made of different materials. A round blank part 12 can be produced in each case from a metal alloy or from plastic or a composite material. The first coin type T1 shown in FIGS. 4 and 5 for example comprises a round blank outer ring 15 and a round blank core 13, each formed from a metal alloy, whereas the round blank inner ring 14 consists of plastic. In a further coin type the round blank inner ring 14 could consist of a metal alloy.

The coins 11 are shown here merely by way of example as circular coins. It goes without saying that other outer contours can also be used, for example polygonal contours. The radial dimensions of the round blank parts 12 can also vary.

The installation 10 shown schematically in FIG. 1 also comprises a transporting device and in the exemplary embodiment a first transporting device 20 and a second transporting device 21. Each transporting device 20, 21 has at least one receptacle 22. A round blank consisting in each case of at least one round blank part 12 or an individual round blank part 12 can be received and transported in the receptacle. In the exemplary embodiment the transporting devices 20, 21 each have a plurality of receptacles 22. The receptacles 22 are immobile relative to one another. In the exemplary embodiment the receptacles 22 of each transporting device 20, 21 are arranged along a circular path, distributed uniformly in accordance with the invention. The receptacles 22 of the first transporting device 20 are arranged in accordance with the example on a first turntable 23 and the receptacles 22 of the second transporting device 21 are arranged on a second turntable 24. The dimensions of the receptacles 22 of the various transporting devices 20, 21 can be different. In accordance with the example the recesses 22 of the second transporting device 21 or of the second turntable 24 have a larger cross-sectional area or a larger diameter than the receptacles 22 of the first transporting device 20 or of the first turntable 23.

Figure 2:
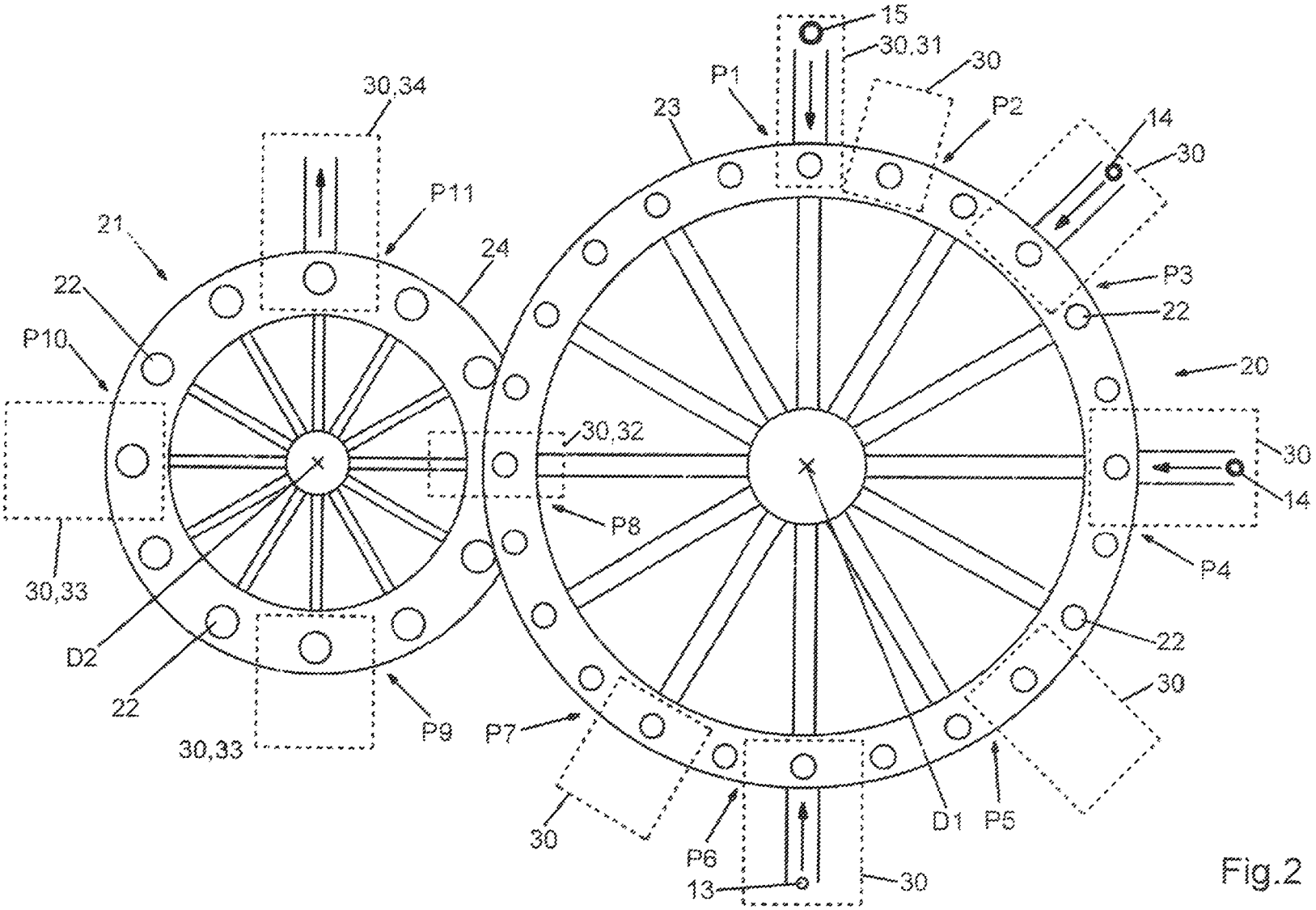
FIG. 2 shows a schematic depiction of an exemplary embodiment of an installation having a plurality of stations.

The first transporting device 20 has a first drive 25 and the second transporting device 21 has a second drive 26. The two drives 25, 26 are designed in accordance with the example as rotary drives for rotating the respective turntable 23, 24 about a first axis of rotation D1 and a second axis of rotation D2 respectively (FIG. 2). The drives 25, 26 are controllable by a control device 27. The control device 27 generates a first drive signal A1 for the first drive 25 and a second drive signal A2 for the second drive 26. The drives can comprise electric servomotors or stepper motors.

It is also possible, instead of the two separate drives, to provide just one drive, which is mechanically coupled to both transporting devices 20, 21. This mechanical coupling can coordinate the movements of the two transporting devices 20, 21 instead of the control device 27.

In the exemplary embodiment the drives 25, 26 are designed to move the receptacles 22 in a clocked manner or intermittently. In accordance with the example the turntables 23, 24 are each moved in a clock pulse by means of a rotary increment movement about the respective axis of rotation D1 or D2. The first clock pulse for the movement of the first turntable 23 can be of a different magnitude here as compared to a second clock pulse for moving the second turntable 24. After each rotary increment movement, the turntables 23, 24 remain in their rotary position for a predefined standstill period. The standstill period in which the receptacles 22 of the first transporting device 20 remain in their positions can be different from the standstill period in which the receptacles 22 of the second transporting device 21 remain at standstill.

A number of stations 30 are arranged on the first transporting device 20. The round blank or the at least one round blank part 12 can be moved in a receptacle 22 into each station 30 on the first transporting device 20. The stations 30 on the first transporting device 20 are preferably used to prepare the round blank for the stamping. Each station 30 on the first transporting device 20 is used to supply the at least one round blank part 12 to the first transporting device 20 and/or to discharge said at least one round blank part from the first transporting device 20 or to process the at least one round blank part or to measure the at least one round blank part or to test the at least one round blank part. The processing of a round blank part shall be understood to mean any process that changes the form of at least one round blank part 12 and/or that modifies the surface. Subsequent processing steps can be carried out for example in one or more stations 30:

- fitting or placing a number of round blank parts 12 one inside the other,
- reshaping at least one round blank part 12, for example by forming an indentation in an inner edge or outer edge of a round blank part 12 or by compressing a round blank part,
- annealing at least one round blank part 12,
- cleaning the at least one round blank part 12,
- printing or coloring at least one round blank part 12,
- coating at least one round blank part 12,
- cutting and/or stamping and/or drilling a starting part, for example for producing a round blank part ring 14, 15 and/or a round blank core 13 from the starting part,
- aligning or positioning two round blank parts 12 relative to one another or relative to the recess 22,
- injection-moulding a round blank part 12,
- measuring and/or testing at least one round blank part 12.

If a station 30 is used for measuring or testing, contact-based or contactless measurement methods or sensors can be provided in this station. For example, at least one dimension or a surface nature of a round blank part 12 can be ascertained and compared with predefined target values.

In the exemplary embodiment at least one supplying station 31 is provided. At least one round blank part 12 required for the production of the relevant type T1, T2, T3 of the coin 11 can be supplied via each supplying station 31. It is also possible to supply round blank parts 12 already placed or fitted one inside the other to the first transporting device 20 via a supplying station 31. At least one station 30 can also be formed simultaneously as a supplying station for a further round blank part 12 and can be designed for placing this further round blank part 12 and a round blank part 12 already provided in a receptacle 22 one inside the other.

Besides at least one supplying station 31, at least one transfer station 32 is provided in accordance with the example, by means of which a one-part or multi-part round blank is transferred from the first transporting device 20 to the second transporting device 21.

At least one stamping station 33 is provided on the second transporting device 21. The round blank consisting of one or more round blank parts 12 is supplied in the stamping station via the second transporting device 21, is stamped to form the coin 11 of the relevant coin type T1, T2, T3, and is discharged again via the second transporting device 21. In addition, a station 30 as outputting station 34 can be formed at the second transporting device 21, with the stamped coins 11 being output or discharged at said outputting station.

As is shown schematically in FIG. 1, all stations 30 are controlled by a control signal Si (i=1, 2, 3, . . . , n). The number of control signals corresponds to the number of provided stations 30. Eleven stations 30 are controlled in FIG. 1, merely by way of example, such that eleven control signals S1 to S11 are used accordingly for the control.

It is also possible to allocate one or more stations 30 with respective sensors which transmit their measurement or sensor signals to the control device 27. The control device 27 can then control the relevant station 30 or also another station 30 depending on the at least one measurement signal or sensor signal. For example, round blank parts 12 deemed to be defective can be conveyed into a station 30 for ejection from the relevant transporting device 20 or 21.

Figure 3:
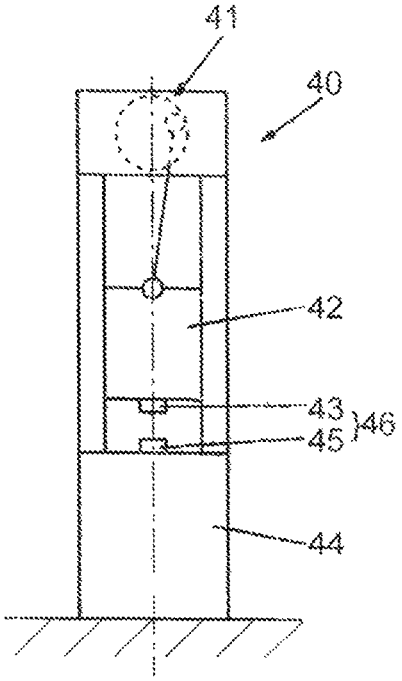
FIG. 3 shows a schematic depiction of a stamping press that can be used in a stamping station of the installation.

At least one stamping station 33 with a stamping press is provided on the second transporting device 21. A heavily schematic depiction of a stamping press 40 is shown in FIG. 3. The stamping press 40 comprises a press drive 41 for driving a movable press ram 42 guided linearly in a stroke direction. An upper tool 43 for the stamping of a coin 11 is arranged on the press ram 42. A lower tool 45 is arranged opposite the upper tool 43 in the stroke direction on a press table 44. The upper tool 43 and the lower tool 45 form the stamping tool 46 for stamping the coin 11.

For each coin type T1, T2, T3 that can be produced in the installation 10, an associated stamping station 33 can be provided. In addition or alternatively, it is also possible to perform a preferably automatically executable tool change of a stamping tool 46 of a stamping press 40, such that coins 11 of a different coin type T1, T2, T3 can be stamped in a stamping press 40 by a corresponding tool exchange of the stamping tool 46. In this case a single stamping station 33 is sufficient.

As explained, the installation 10 is designed to be able to produce coins 11 of different types T1, T2, T3. For this purpose, all stations 30 that are necessary for the production of the coin types T1, T2, T3 are provided. Each station 30 is arranged at a fixedly predefined station place Pi (i=1 to n) and remains constructed there independently of which coin type T1, T2, T3 is to be produced. The stations 30 are therefore not fully constructed or fully dismantled depending on the coin type to be produced. Rather, stations 30 that are not required for the production of a certain coin type are deactivated by the control device 27 and switched into an idle state so to speak. The stations 30 required depending on the coin type T1, T2, T3 to be produced are activated by the control device 27 and used in the production of the coins 11 of this coin type.

The control device 27 controls the two transporting devices 20, 21 in such a way that the at least one round blank part 12 required to produce the coin type runs through a predefined transport sequence through the stations 30. Here, it can be that the at least one round blank part 12 can also be transported in passive stations 30, but neither measured nor processed there, but instead merely remains in the passive station 30 during the relevant standstill phase between two transport steps, in order to then be transported on further.

The second drive signal A2 for the second transporting device 21 is adapted to the stroke number of the stamping press 40 of the stamping station 33 at the second transporting device 21. Here, the temporal transport of the round blanks into the stamping press 40 and from the stamping press 40 is performed in such a way that, with each working stroke of the press ram 42, a round blank is arranged between the upper tool 43 and the lower tool 45. An empty stroke without round blank in the stamping tool 46 is avoided. Here, with each working stroke of the press ram 42, a round blank to be stamped can be supplied and a stamped coin 11 can be discharged. It is also possible that the press ram 42 performs two or more working strokes on the same round blank, before this is discharged again from the stamping press 40. The stamping press 40 must be operated here always with a certain minimum number of strokes in accordance with the example in order to provide a sufficient kinetic energy in the press ram 42. For example, 300 to 400 strokes/min are necessary.

The two transporting devices 20, 21 are mechanically decoupled and can be moved over time independently of one another via the two drive signals A1, A2. Thus, the stations 30 and the first transporting device 20 can be controlled temporally independently of the set and necessary number of strokes of the stamping press 40, which enables a high flexibility. The first transporting device 20 and the stations 30 arranged thereon are controlled and clocked accordingly by the control device 27 depending on the coin type T1, T2, T3 of the coin 11 to be produced.

FIG. 2, for one exemplary embodiment of an installation 10, shows an exemplary selection of stations 30. A first supplying device 31 for supplying a round blank outer ring 15 is provided at the first station place P1. As viewed in a clockwise direction, a station 30 for reshaping the inner edge of the round blank outer ring 15 is provided adjacently thereto at the second station place P2. At a third station place P3, there is provided a station 30 for supplying and inserting a round blank inner ring 14 made of plastic into the round blank outer ring 15 already supplied. A station 30 for supplying and inserting a metal round blank inner ring 14 into the supplied round blank outer ring 15 is provided at a fourth station place P4. Since plastic rings and metal rings behave completely differently during transport and fitting one inside the other on account of the different mass and the different spring rigidity, two separate stations 30 are provided here, which can be activated alternatively to one another depending on the coin type.

A station 30 for testing can then be provided at a fifth station place P5, in which station it is tested whether the round blank inner ring 14 has been inserted correctly into the round blank outer ring 15. If this is not the case, rings 14, 15 inserted incorrectly one into the other can be ejected at this station 30.

A station 30 for supplying and inserting a round blank core 13 is provided at a sixth station place P6. The round blank core 30 is inserted into the at least one round blank ring 14, 15.

A station 30 for testing whether the round blank core 13 has been correctly inserted into the at least one round blank ring 14, 15 is provided at a seventh station place P7. Round blank parts inserted incorrectly one inside the other can also be ejected via this station.

The transfer station 32 is provided at an eighth station place P8, by means of which transfer station the one-part or multi-part round blanks are transferred to the second transporting device 21.

At the second transporting device 21, a stamping station 33 is provided at a ninth station place P9 and at a tenth station place P10. The stamping stations 33 are provided to stamp different coin types. An outputting station 34 is provided at an eleventh station place P11.

The above-mentioned stations 30 are used merely to explain a possible configuration of an installation 10 and are merely exemplary. Depending on which different coin types T1, T2, T3 are to be produced, the installation 10 can also have more or fewer stations 30 or other stations 30. The stations for testing can be omitted, for example. It is also possible to provide merely one testing station for testing the stamped coins 11. This can be arranged before the outputting station 34 or can be integrated in the outputting station 34 and can eject the defective coins separately.

If a three-part coin with a round blank inner ring 14 made of plastic is produced by means of the installation 10 shown in FIG. 2, the control device 21 activates the stations 30 at the station places P1, P2, P3, P6, P8, P10 and P11. Optionally, the stations for testing at the station places P5 and P7 can likewise be activated. If, for example, a one-part coin of coin type T2 is to be produced, the disc 16 can be supplied via the supplying station 31 at the first station place P1 and transferred via the transfer station 32. All other stations 32 at the first transporting device 20 can then be deactivated. For stamping, the stamping station 33 at station place P9 is activated and the stamping station 33 at the station place P10 is deactivated, for example.

In order to transport different coin types, in which the round blank parts 12 have different diameters or dimensions, the first transporting device 20 and/or the second transporting device 21 can be modified. For example, the dimensions of the receptacles 22 can be adapted for production of coins of different sizes. It is possible for example to design the first turntable 23 and/or the second turntable 24 exchangeably or to design receiving parts of the turntables 23 and/or 24, which contain the receptacle 22, exchangeably. The structural modifications at the transporting devices 20 or 21 can then be made depending on the coin type to be produced.

The invention relates to a flexible installation 10 for producing at least two types T1, T2, T3 of coins 11 to be produced. In particular, the different coin types T1, T2, T3 have a different number of round blank parts 12 and/or have round blank parts 12 made of different materials. The type and number of work steps necessary to produce the coins 11 of the coin type T1, T2, T3 in question differ between the different coin types T1, T2, T3. The installation 10 has a number of stations 30, in which a round blank part 12 is supplied and/or output and/or processed and/or measured and/or tested. At least one transporting device 20, 21 acts to transport the at least one round blank part 12 between the stations. Preferably, two transporting devices 20, 21 are present, which can be controlled independently of each other and cooperate via a transfer station 32 for the at least one round blank part 12. A control device 27 controls the at least one transporting device 20, 21 and the stations 30 depending on the coin type to be produced.

LIST OF REFERENCE SIGNS

10 installation
11 coin
12 round blank part
13 round blank core
14 round blank inner ring
15 round blank outer ring
16 disc
20 first transporting device
21 second transporting device
22 receptacle
23 first turntable
24 second turntable
25 first drive
26 second drive
27 control device
30 station
31 supplying station
32 transfer station
33 stamping station
34 outputting station
40 stamping press
41 press drive
42 press ram
43 upper tool
44 press table
45 lower tool
46 stamping tool
A1 first drive signal
A2 second drive signal D1 first axis of rotation
D2 second axis of rotation
Pi station place i (i=1, 2, 3 . . . n)
Si control signal i (i=1, 2, 3 . . . n)
T1 first coin type
T2 second coin type
T3 third coin type

What is claimed is:

1. An installation (10) for processing round blank parts (12) in the production of coins (11) of different types (T1, T2, T3) in each case from at least round blank part (12), said installation (10) comprising:

a predetermined number of stations (30) adapted to process the round blank parts (12) into stamped coins (11);

a first number of the predetermined number of stations (30) are allocated to a first transport device (20), the first transporting device (20) comprises a first turntable (23), the first number of stations (30) are configured to supply the at least one round blank part (12) to the first transporting device (20) or to process, measure or test said at least one round blank part in a respective station (30) of the first number of stations (30), the first number of stations (30) arranged at the first transporting device (20) configured to prepare the at least one round blank part (12) into a completely assembled assembly of the at least one round blank part (12) ready for stamping into a minted stamped coin (11), wherein the first transporting device (20) has at least one receptacle (22) for the at least one round blank part (12) to be transported and is configured to transport the at least one round blank part (12) between the first number of stations (30), a second number of the predetermined number of stations (30) are allocated to a second transporting device (21), the second transporting device (21) comprises a second turntable (24), the second number of stations (30) include at least one stamping station (33) arranged at the second transporting device (21), the second transporting device (21) configured to transport the completely assembled assembly of the at least one round blank part (12) to the at least one stamping station (33) to be embossed, the at least one stamping station (33) adapted to emboss the completely assembled assembly of the at least one round blank part (12) into the minted stamped coin (11), one of the predetermined number of stations (30) is a transfer station (32) in operative arrangement between the first transporting device (20) and the second transporting device (21), the transfer station (32) configured to transfer from the first transporting device (20) to the second transporting device (21) the completely assembled assembly of the at least one round blank part (12), a control device (27) having a plurality of outputs, a predetermined number of the outputs each corresponding to a control signal Si (i=1, 2, 3, . . . , n), where (n) corresponds to the predetermined number of the stations (30), the control device (27) configured to control each of the predetermined number of the stations (30) and to activate some of the predetermined number of the stations (30) by sending an appropriate control signal Si (i=1, 2, 3, . . . , n) necessary for production of the coin type (T1, T2, T3) to a respective input Si (i=1, 2, 3, . . . , n) of a respective station (30) of the predetermined number of stations (30) to be activated and to deactivate others of the predetermined number of the stations (30) by sending an appropriate control signal Si (i=1, 2, 3, . . . , n) to a respective input Si (i=1, 2, 3, . . . , n) of each respective station (30) of the predetermined number of the stations (30) to be deactivated depending on the type (T1, T2, T3) of coin (11) to be produced, and wherein the plurality of outputs of the control device (27) also includes a predetermined number of outputs each corresponding to at least two drive signals (A1, A2), a first drive signal (A1) of the at least two drive signals (A1, A2) for controlling a first drive (25) for driving the first transporting device (20), the control device (27) is configured to control the first transporting device (20) by sending the first drive signal (A1) to an input of the first drive (25) of the first transporting device (20) to specify the order in which the at least one round blank part (12) used for production of the coin type (T1, T2, T3) is transported between the first number of stations (30) depending on the type (T1, T2, T3) of the coin (11) to be produced and configured to control the second transporting device (21) by sending a second drive signal (A2) of the at least two drive signals (A1, A2) adapted to an operating speed of the at least one stamping station (33) to an input of a second drive (26) of the second transporting device (21).

2. The installation according to claim 1, characterised in that a component of the first transporting device (20) comprising the at least one receptacle (22) can be exchanged depending on the coin type (T1, T2, T3) to be produced.

3. The installation according to claim 1, characterised in that at least one of a separate stamping station (33) is provided for each of two of the coins (11) of the different types (T1, T2, T3), and the at least one stamping station (33) has an exchangeable stamping tool for each of the two of the coins (11) of different types (T1, T2, T3).

4. The installation according to claim 1, wherein the second transporting device (21) has at least one receptacle (22) for the at least one round blank part (12) to be transported and which is configured to transport the at least one round blank part (12) to the at least one stamping station (33).

5. The installation according to claim 4, characterised in that a component of the second transporting device (21) comprising at least one receptacle (22) of the second transporting device (21) can be exchanged depending on the coin type (T1, T2, T3) to be produced.

6. The installation according to claim 4, characterised in that the control device (27) is configured to control the first transporting device (20) in such a way that the at least one round blank part (12) is transported by the first transporting device (20) between the first number of stations (30) in a first clock pulse, and the control device (27) is configured to control the second transporting device (21) in such a way that the at least one round blank part (12) is transported by the second transporting device (21) in a second clock pulse.

7. The installation according to claim 6, characterised in that the at least one stamping station (33) comprises a stamping press (40) including a press ram (42), wherein the second clock pulse is adapted to a working stroke movement of the press ram (42) of the stamping press (40).

8. The installation according to claim 7, characterised in that with each of the working stroke movements of the press ram (42) a round blank that is to be stamped and that consists of at least one round blank part (12) is provided in the stamping press (40) between a lower tool (45) and an upper tool (43) of the stamping press (40).

9. The installation according to claim 1, characterised in that each of the predetermined number of stations (30) is arranged at a predefined station place (P1, P2, . . . P11) of at least one of the first transporting device (20) and the second transporting device (21), wherein the allocation of each of the predetermined number of stations (30) with the station places (P1, P2, . . . P11) is maintained independently of the coin type (T1, T2, T3) to be produced.

10. The installation according to claim 1, characterised in that each of the predetermined number of stations (30) are arranged adjacently along a circular path of at least one of the first transporting device (20) and a second transporting device (21).

11. The installation according to claim 1, characterised in that the predetermined number of stations (30) include at least four stations (30) are provided.

* * * * *